US007513300B2

(12) United States Patent
Pietras et al.

(10) Patent No.: US 7,513,300 B2
(45) Date of Patent: Apr. 7, 2009

(54) CASING RUNNING AND DRILLING SYSTEM

(75) Inventors: Bernd-Georg Pietras, Wedgemark (DE); Thomas F. Bailey, Houston, TX (US); Adrian Vuyk, Jr., Houston, TX (US); Carl J. Wilson, Hockley, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/688,619

(22) Filed: Mar. 20, 2007

(65) Prior Publication Data

US 2007/0193751 A1 Aug. 23, 2007

Related U.S. Application Data

(63) Continuation of application No. 10/794,795, filed on Mar. 5, 2004, now Pat. No. 7,191,840, application No. 11/688,619, which is a continuation-in-part of application No. 11/288,976, filed on Nov. 29, 2005, now Pat. No. 7,219,744, which is a continuation of application No. 10/738,950, filed on Dec. 17, 2003, now Pat. No. 7,021,374, which is a continuation of application No. 10/354,226, filed on Jan. 29, 2003, now Pat. No. 6,688,398, which is a continuation of application No. 09/762,698, filed as application No. PCT/GB99/02704 on Aug. 16, 1999, now Pat. No. 6,527,047.

(60) Provisional application No. 60/451,964, filed on Mar. 5, 2003.

(30) Foreign Application Priority Data

Aug. 24, 1998 (GB) ..... 9818366.8

(51) Int. Cl.
*E21B 19/16* (2006.01)
*E21B 19/10* (2006.01)
*E21B 7/20* (2006.01)

(52) U.S. Cl. ..... 166/77.51; 166/380; 166/85.1; 175/113; 294/86.12

(58) Field of Classification Search ..... 166/77.51, 166/380, 85.1; 464/163–166; 175/113, 423; 294/86.12, 86.24, 86.26
See application file for complete search history.

(56) References Cited

U.S. PATENT DOCUMENTS 179,973 A 7/1876 Thornton (Continued)

FOREIGN PATENT DOCUMENTS

CA 2 307 386 11/2000

(Continued)

OTHER PUBLICATIONS

"First Success with Casing-Drilling" World Oil, Feb. 1999, pp. 25.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

(Continued)

*Primary Examiner*—Kenneth Thompson
(74) *Attorney, Agent, or Firm*—Patterson & Sheridan, LLP

(57) ABSTRACT

A method and apparatus for holding and turning a tubular and string of tubulars, such as casing, for make-up and drilling with the tubulars are disclosed. The apparatus generally includes a spear and a clamping head, both of which are mounted to a top drive. The spear and the clamping head can be engaged to transmit torque therebetween from the top drive. In addition, an aspect of the invention provides variable height wickers positioned on slips to enable use of the slips with variable inner diameter (ID) and weight casing without deformation or rupture of the casing. Still further, a casing collar is also provided to provide reinforcement to the casing in the area of slip contact with the casing ID.

37 Claims, 13 Drawing Sheets

U.S. PATENT DOCUMENTS

| | | | | |
|---|---|---|---|---|
| 1,414,207 | A | | 4/1922 | Reed |
| 1,418,766 | A | | 6/1922 | Wilson |
| 1,585,069 | A | | 5/1926 | Youle |
| 1,728,136 | A | | 9/1929 | Power |
| 1,777,592 | A | | 10/1930 | Thomas |
| 1,805,007 | A | | 5/1931 | Pedley |
| 1,825,026 | A | | 9/1931 | Thomas |
| 1,842,638 | A | | 1/1932 | Wigle |
| 1,917,135 | A | | 7/1933 | Littell |
| 2,105,885 | A | | 1/1938 | Hinderliter |
| 2,128,430 | A | | 8/1938 | Pryor |
| 2,167,338 | A | | 7/1939 | Murcell |
| 2,184,681 | A | | 12/1939 | Osmun et al. |
| 2,214,429 | A | | 9/1940 | Miller |
| 2,414,719 | A | | 1/1947 | Cloud |
| 2,522,444 | A | | 9/1950 | Grable |
| 2,536,458 | A | | 1/1951 | Munsinger |
| 2,570,080 | A | | 10/1951 | Stone |
| 2,582,987 | A | | 1/1952 | Hagenbook |
| 2,595,902 | A | | 5/1952 | Stone |
| 2,610,690 | A | | 9/1952 | Beatty |
| 2,641,444 | A | | 6/1953 | Moon |
| 2,668,689 | A | | 2/1954 | Cormany |
| 2,692,059 | A | | 10/1954 | Bolling, Jr. |
| 2,953,406 | A | | 9/1960 | Young |
| 2,965,177 | A | | 12/1960 | Bus, Sr. et al. |
| 3,041,901 | A | | 7/1962 | Knights |
| 3,087,546 | A | | 4/1963 | Wooley |
| 3,122,811 | A | | 3/1964 | Gilreath |
| 3,191,683 | A | | 6/1965 | Alexander |
| 3,193,116 | A | | 7/1965 | Kenneday et al. |
| 3,266,582 | A | | 8/1966 | Homanick |
| 3,305,021 | A | | 2/1967 | Lebourg |
| 3,321,018 | A | | 5/1967 | McGill |
| 3,380,528 | A | | 4/1968 | Timmons |
| 3,392,609 | A | | 7/1968 | Bartos |
| 3,447,652 | A | * | 6/1969 | Tipton ..... 192/85 AT |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,566,505 | A | | 3/1971 | Martin |
| 3,570,598 | A | | 3/1971 | Johnson |
| 3,602,302 | A | | 8/1971 | Kluth |
| 3,606,664 | A | | 9/1971 | Weiner |
| 3,635,105 | A | | 1/1972 | Dickmann et al. |
| 3,638,989 | A | | 2/1972 | Sandquist |
| 3,662,842 | A | | 5/1972 | Bromell |
| 3,680,412 | A | | 8/1972 | Mayer et al. |
| 3,691,825 | A | | 9/1972 | Dyer |
| 3,697,113 | A | | 10/1972 | Palauro et al. |
| 3,700,048 | A | | 10/1972 | Desmoulins |
| 3,706,347 | A | | 12/1972 | Brown |
| 3,746,330 | A | | 7/1973 | Taciuk |
| 3,747,675 | A | | 7/1973 | Brown |
| 3,766,991 | A | | 10/1973 | Brown |
| 3,776,320 | A | | 12/1973 | Brown |
| 3,780,883 | A | | 12/1973 | Brown |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,920,087 | A | * | 11/1975 | Hisey et al. ..... 173/164 |
| 3,961,399 | A | | 6/1976 | Boyadjieff |
| 3,964,552 | A | | 6/1976 | Slator |
| 3,980,143 | A | | 9/1976 | Swartz et al. |
| 3,994,350 | A | * | 11/1976 | Smith et al. ..... 175/85 |
| 4,054,332 | A | | 10/1977 | Bryan, Jr. |
| 4,077,525 | A | | 3/1978 | Callegari et al. |
| 4,100,968 | A | | 7/1978 | Delano |
| 4,127,927 | A | | 12/1978 | Hauk et al. |
| 4,142,739 | A | | 3/1979 | Billingsley |
| 4,202,225 | A | | 5/1980 | Sheldon et al. |
| 4,221,269 | A | | 9/1980 | Hudson |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,280,380 | A | | 7/1981 | Eshghy |
| 4,309,922 | A | * | 1/1982 | Beckley et al. ..... 81/57.16 |
| 4,315,553 | A | | 2/1982 | Stallings |
| 4,320,915 | A | | 3/1982 | Abbott et al. |
| 4,401,000 | A | | 8/1983 | Kinzbach |
| 4,437,363 | A | | 3/1984 | Haynes |
| 4,440,220 | A | | 4/1984 | McArthur |
| 4,446,745 | A | | 5/1984 | Stone et al. |
| 4,449,596 | A | * | 5/1984 | Boyadjieff ..... 175/85 |
| 4,472,002 | A | | 9/1984 | Beney et al. |
| 4,489,794 | A | | 12/1984 | Boyadjieff |
| 4,492,134 | A | | 1/1985 | Reinhldt et al. |
| 4,494,424 | A | | 1/1985 | Bates |
| 4,515,045 | A | | 5/1985 | Gnatchenko et al. |
| 4,529,045 | A | | 7/1985 | Boyadjieff et al. |
| 4,570,706 | A | | 2/1986 | Pugnet |
| 4,592,125 | A | | 6/1986 | Skene |
| 4,593,584 | A | | 6/1986 | Neves |
| 4,593,773 | A | | 6/1986 | Skeie |
| 4,604,724 | A | | 8/1986 | Shaginian et al. |
| 4,604,818 | A | | 8/1986 | Inoue |
| 4,605,077 | A | | 8/1986 | Boyadjieff |
| 4,613,161 | A | | 9/1986 | Brisco |
| 4,625,796 | A | | 12/1986 | Boyadjieff |
| 4,646,827 | A | | 3/1987 | Cobb |
| 4,649,777 | A | | 3/1987 | Buck |
| 4,652,195 | A | | 3/1987 | McArthur |
| 4,667,752 | A | | 5/1987 | Berry et al. |
| 4,676,312 | A | | 6/1987 | Mosing et al. |
| 4,681,158 | A | | 7/1987 | Pennison |
| 4,681,162 | A | | 7/1987 | Boyd |
| 4,683,962 | A | | 8/1987 | True |
| 4,686,873 | A | | 8/1987 | Lang et al. |
| 4,709,599 | A | | 12/1987 | Buck |
| 4,709,766 | A | | 12/1987 | Boyadjieff |
| 4,725,179 | A | | 2/1988 | Woolslayer et al. |
| 4,735,270 | A | | 4/1988 | Fenyvesi |
| 4,738,145 | A | | 4/1988 | Vincent et al. |
| 4,742,876 | A | | 5/1988 | Barthelemy et al. |
| 4,759,239 | A | | 7/1988 | Hamilton et al. |
| 4,762,187 | A | | 8/1988 | Haney |
| 4,765,401 | A | | 8/1988 | Boyadjieff |
| 4,765,416 | A | | 8/1988 | Bjerking et al. |
| 4,773,689 | A | | 9/1988 | Wolters |
| 4,781,359 | A | | 11/1988 | Matus |
| 4,791,997 | A | | 12/1988 | Krasnov |
| 4,793,422 | A | | 12/1988 | Krasnov |
| 4,800,968 | A | | 1/1989 | Shaw et al. |
| 4,813,493 | A | | 3/1989 | Shaw et al. |
| 4,813,495 | A | | 3/1989 | Leach |
| 4,821,814 | A | | 4/1989 | Willis et al. |
| 4,832,552 | A | | 5/1989 | Skelly |
| 4,836,064 | A | | 6/1989 | Slator |
| 4,843,945 | A | | 7/1989 | Dinsdale |
| 4,867,236 | A | | 9/1989 | Haney et al. |

4,875,530 A 10/1989 Frink et al.
4,878,546 A 11/1989 Shaw et al.
4,899,816 A 2/1990 Mine
4,909,741 A 3/1990 Schasteen et al.
4,921,386 A 5/1990 McArthur
4,936,382 A 6/1990 Thomas
4,962,579 A 10/1990 Moyer et al.
4,962,819 A 10/1990 Bailey et al.
4,971,146 A 11/1990 Terrell
4,997,042 A 3/1991 Jordan et al.
5,022,472 A 6/1991 Bailey et al.
5,036,927 A 8/1991 Willis
5,049,020 A 9/1991 McArthur
5,060,542 A 10/1991 Hauk
5,062,756 A 11/1991 McArthur et al.
5,107,940 A 4/1992 Berry
5,111,893 A 5/1992 Kvello-Aune
RE34,063 E 9/1992 Vincent et al.
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A * 10/1993 Stogner ..... 175/203
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tassari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,189,621 B1 2/2001 Vail, III
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 * 11/2001 Scott et al. ..... 175/162
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 3/2003 Snider et al.
6,553,825 B1 4/2003 Boyd
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 6/2004 Haugen
6,832,656 B2 12/2004 Cameron
6,832,658 B2 12/2004 Keast
6,840,322 B2 1/2005 Haynes
6,892,835 B2 5/2005 Shahin et al.
6,907,934 B2 6/2005 Kauffman et al.
6,938,697 B2 9/2005 Haugen
6,976,298 B1 12/2005 Pietras
7,004,259 B2 2/2006 Pietras
7,028,586 B2 4/2006 Robichaux
7,073,598 B2 7/2006 Haugen
7,090,021 B2 8/2006 Pietras
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,140,445 B2 11/2006 Shahin et al.
7,188,686 B2 3/2007 Folk et al.
7,191,840 B2 * 3/2007 Pietras et al. ..... 166/380
7,213,656 B2 5/2007 Pietras
7,325,610 B2 2/2008 Giroux et al.
2001/0042625 A1 11/2001 Appleton
2002/0029878 A1 3/2002 Victor

| | | | |
|---|---|---|---|
| 2002/0108748 | A1 | 8/2002 | Keyes |
| 2002/0170720 | A1 | 11/2002 | Haugen |
| 2003/0155159 | A1 | 8/2003 | Slack et al. |
| 2003/0164276 | A1 | 9/2003 | Snider et al. |
| 2003/0173073 | A1 | 9/2003 | Snider et al. |
| 2003/0221519 | A1 | 12/2003 | Haugen et al. |
| 2004/0003490 | A1 | 1/2004 | Shahin et al. |
| 2004/0069500 | A1 | 4/2004 | Haugen |
| 2004/0144547 | A1 | 7/2004 | Koithan et al. |
| 2004/0173358 | A1 | 9/2004 | Haugen |
| 2004/0216924 | A1 | 11/2004 | Pietras et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |
| 2006/0000600 | A1 | 1/2006 | Pietras |
| 2006/0124353 | A1 | 6/2006 | Juhasz et al. |
| 2006/0180315 | A1 | 8/2006 | Shahin et al. |
| 2007/0000668 | A1 | 1/2007 | Christensen |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 469 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 345 074 | 6/2000 |
| GB | 2 357 530 | 6/2001 |
| JP | 2001/173349 | 6/2001 |
| WO | WO 90-06418 | 6/1990 |
| WO | WO 92-18743 | 10/1992 |
| WO | WO 93-07358 | 4/1993 |
| WO | WO 95-10686 | 4/1995 |
| WO | WO 96-18799 | 6/1996 |
| WO | WO 97-08418 | 3/1997 |
| WO | WO 98-05844 | 2/1998 |
| WO | WO 98-11322 | 3/1998 |
| WO | WO 98-32948 | 7/1998 |
| WO | WO 99/11902 | 3/1999 |
| WO | WO 99-41485 | 8/1999 |
| WO | WO 99-58810 | 11/1999 |
| WO | WO 00-08293 | 2/2000 |
| WO | WO 00-09853 | 2/2000 |
| WO | WO 00/11309 | 3/2000 |
| WO | WO 00-11309 | 3/2000 |
| WO | WO 00-11310 | 3/2000 |
| WO | WO 00-11311 | 3/2000 |
| WO | WO 00/39429 | 7/2000 |
| WO | WO 00-39429 | 7/2000 |
| WO | WO 00-39430 | 7/2000 |
| WO | WO 00-50730 | 8/2000 |
| WO | WO 01-33033 | 5/2001 |
| WO | WO 01-94738 | 12/2001 |
| WO | WO 2004-022903 | 3/2004 |
| WO | WO 2005/090740 | 9/2005 |

OTHER PUBLICATIONS

Laurent, et al., "Hydraulic Rig Supports Casing Drilling." World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conference, Mar. 27-29, 2001, pp. 1-10.

Fontenol, et al., "New Rig Design Enhances Casing Drilling Operations In Lobo Trend," paper WOCD-0306-04, World Oil Casing Drilling Technical Conference, Mar. 6-7, 2003, pp. 1-13.

Vincent, et al., "Liner And Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Market?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) Canrig Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection For Stratton Field, Texas, World Oil, vol. 226, No. 3, Mar. 2005.

G H. Kamphorst, G. L. Van Wechem, W. Boom, D. Bottger, and K. Koch, Casing Running Tool, SPE/IADC 52770.

Canadian Office Action, Application No. 2,517,895, dated Mar. 26, 2008.

* cited by examiner

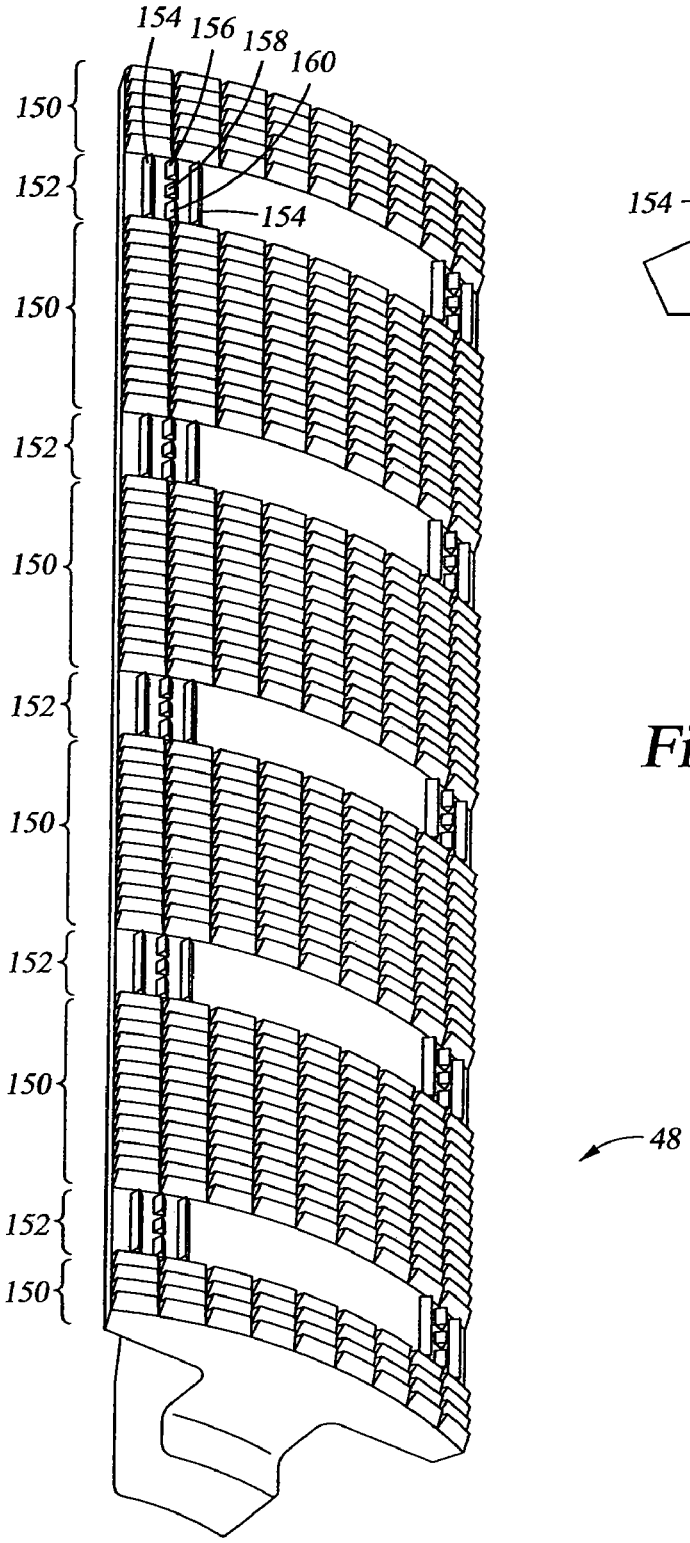
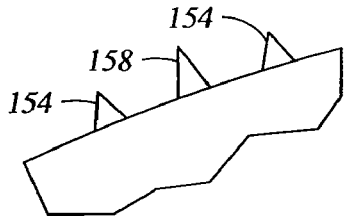
Fig. 8B
Fig. 8A

CASING RUNNING AND DRILLING SYSTEM

CROSS-REFERENCE TO RELATED APPLICATIONS

This application is a continuation of U.S. patent application Ser. No. 10/794,795, filed Mar. 5, 2004, now U.S. Pat. No. 7,191,840, which claims benefit of U.S. Provisional Patent Application Ser. No. 60/451,964, filed Mar. 5, 2003, which applications are herein incorporated by reference in their entirety.

This application is also a continuation-in-part of U.S. patent application Ser. No. 11/288,976, filed on Nov. 29, 2005, now U.S. Pat. No. 7,219,744; which is a continuation of U.S. patent application Ser. No. 10/738,950, filed on Dec. 17, 2003, now U.S. Pat. No. 7,021,374; which is a continuation of U.S. patent application Ser. No. 10/354,226, filed on Jan. 29, 2003, now U.S. Pat. No. 6,688,398; which is a continuation of U.S. patent application Ser. No. 09/762,698, filed on May 10, 2001, now issued U.S. Pat. No. 6,527,047, issued Mar. 4, 2003; which claims priority to PCT/GB99/02704, filed on Aug. 16, 1999; which claims benefit of GB 9818366.8 filed Aug. 24, 1998, filed in Great Britain. Each of the aforementioned related patent applications is herein incorporated by reference in their entirety.

BACKGROUND OF THE INVENTION

1. Field of the Invention

Embodiments of the present invention generally relate to methods and apparatus useful in the exploration for hydrocarbons located in subsurface formations. More particularly, the invention relates to the use of tubulars, such as casing, and drilling with such casing using a top drive.

2. Description of the Related Art

In the construction of oil and gas wells, it is usually necessary to line the borehole with a string of tubulars, known as casing, which are sequentially threaded together and lowered down a previously drilled borehole. Because of the length of the casing required, sections or stands of two or more individual lengths of casing are progressively added to the string as it is lowered into the well from a drilling platform. To add additional lengths of casing to that already in the borehole, the casing already lowered into the borehole is typically restrained from falling into the well by using a spider located in the floor of the drilling platform. The casing to be added is then moved from a rack to a position above the exposed top of the casing situated in the spider. The threaded pin (male threaded section) of this section or stand of casing to be connected is then lowered over the threaded box (female threaded section) of the end of the casing extending from the well, and the casing to be added is connected to the existing casing in the borehole by rotation therebetween. An elevator is then connected to the top of the new section or stand and the whole casing string is lifted slightly to enable the slips of the spider to be released. The whole casing string, including the added length(s) of casing, is lowered into the borehole until the top of the uppermost section of casing is adjacent to the spider whereupon the slips of the spider are reapplied, the elevator is disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection. A top drive is a top driven rotational system used to rotate the drill string for drilling purposes.

It is also known to use the casing, which is typically only lowered into the borehole after a drill string and drill bit(s) have been used to create the borehole, to actually drive the drill bit to create the borehole, thereby eliminating the need to remove the drill string and then lower the casing into the borehole. This process results in a substantial increase in productivity since the drill string is never removed from the borehole during drilling. To enable this efficiency, the casing is cemented in place once each drill bit or drill shoe reaches its desired or capable depth, and a new drill bit and casing string are lowered through the existing casing to continue drilling into the earth formation. The borehole can be drilled to the desired depth by repeating this pattern.

The use of casing as the rotational drive element to rotate the drill shoe or drill bit in situ has revealed several limitations inherent in the structure of the casing as well as the methodologies used to load and drive the casing. For example, the thread form used in casing connections is more fragile than the connection used in drill pipe, and the casing connections have to remain fluid and pressure tight once the drilling process has been completed. Additionally, casing typically has a thinner wall and is less robust than drill pipe. This is especially true in the thread area at both ends of the casing where there is a corresponding reduction in section area. Furthermore, casing is not manufactured or supplied to the same tolerances as drill string, and thus the actual diameters and the wall thicknesses of the casing may vary from lot to lot of casing. Despite these limitations, casing is being used to drill boreholes effectively.

It is known in the industry to use top drive systems to rotate a casing string to form a borehole. However, in order to drill with casing, most existing top drives require a crossover adapter to connect to the casing. This is because the quill of the top drive is not sized to connect with the threads of the casing. The quill of the top drive is typically designed to connect to a drill pipe, which has a smaller outer diameter than a casing. The crossover adapter is design to alleviate this problem. Typically, one end of the crossover adapter is designed to connect with the quill, while the other end is designed to connect with the casing.

However, the process of connecting and disconnecting a casing is time consuming. For example, each time a new casing is added, the casing string must be disconnected from the crossover adapter. Thereafter, the crossover adapter must be threaded into the new casing before the casing string may be run. Furthermore, this process also increases the likelihood of damage to the threads, thereby increasing the potential for downtime.

More recently, top drive adapters have been developed to facilitate the casing handling operations and to impart torque from the top drive to the casing. Generally, top drive adapters are equipped with gripping members to grippingly engage the casing string to transmit torque applied from the top drive to the casing. Top drive adapters may include an external gripping device such as a torque head or an internal gripping device such as a spear.

The spear typically includes a series of parallel circumferential wickers that grip the casing to help impart rotational or torsional loading thereto. Torque is transferred from the top drive to the spear. Typically, the spear is inserted into the interior of the uppermost length of the string of casing, engaged against the inner circumference of the casing, and turned to rotate the string of casing and drill shoe in the borehole.

When a spear is used for drilling with casing (DWC), the spear is known to damage the interior surfaces of the casing, thereby resulting in raised sharp edges as well as plastic deformation of the casing caused by excessive radial loading of the spear. Scarring or other sources of sharp raised edges interfere with the completion of, and production from, the well formed by the borehole, because rubber, plastic and other readily torn or cut materials are often positioned down the casing to affect the completion and production phases of well life. Further, the ultimate strength of the individual casing joint deformed is reduced if the casing undergoes plastic deformation, and the casing joint may later fail by rupture as it is being used downhole during or after drilling operations. Finally, it is known that the load necessary to grip a string of casing in a well may result in rupture of the casing.

Therefore, there exists a need for a drilling system which enables make up of casing and drilling with casing following make up. Preferably, the drilling system can accommodate variable sizes and weights of casing without causing deformation or rupture of the casing.

SUMMARY OF THE INVENTION

The present invention generally provides method and apparatus for the improved performance of drilling with casing systems, in which the casing is assembled into the drill string and driven by the top drive. Improved loading performance is provided to reduce the incidence of casing deformation and internal damage.

In one aspect, the invention includes a spear having at least one slip element that is selectively engageable against the interior of a casing string with selectable loading. A clamping head is also provided for retrieving and moving a piece of casing into a make up position and then facilitating make up using the rotation from the top drive.

In a further aspect, the slip may include varying wickers, whereby the wickers may be used to change the frictional resistance to slippage of the casing on the spear in response to the approach of a slippage condition. In a still further aspect, the invention may provide a compensation element that is positionable to enable gripping of different diameter casing without deformation. In still another aspect, apparatus are provided for reinforcing the casing to prevent deformation of the casing during engagement of the casing by a spear and drilling with casing operations which follow such engagement.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8A is a perspective view of a slip having a plurality of wickers disposed thereon.

FIG. 8B is a partial cross-sectional view of vertical wickers disposed on a slip.

DETAILED DESCRIPTION OF THE PREFERRED EMBODIMENT

The present invention generally comprises a casing running and drilling system including a spear or grapple tool and a clamping head integral to a top drive. In at least one embodiment, the axial load of tubular lengths being added to a tubular string is held by the spear at least during drilling, and the torsional load is supplied by the clamping head at least during make up and thereafter by the spear, and alternatively by the spear and/or the clamping head. The clamping head assembly may also be used to position a tubular below the spear in order to enable cooperative engagement of the clamping tool and spear such that the spear inserted into the tubular and the clamping head are mechanically engaged with one another so that torque from the top drive can be imparted to the tubular through the clamping head. Additionally, a casing collar and the clamping head have external support functions to minimize the risk of deforming the tubular when the spear engages the inner diameter (ID) of the tubular.

In a further embodiment, the spear imparts rotary motion to tubulars forming a drilling string, in particular where the tubulars are casing. In a still further aspect, a thickness compensation element is provided to enable the spear to load against the interior of the tubular without risk of deforming the tubular.

Figure 1:
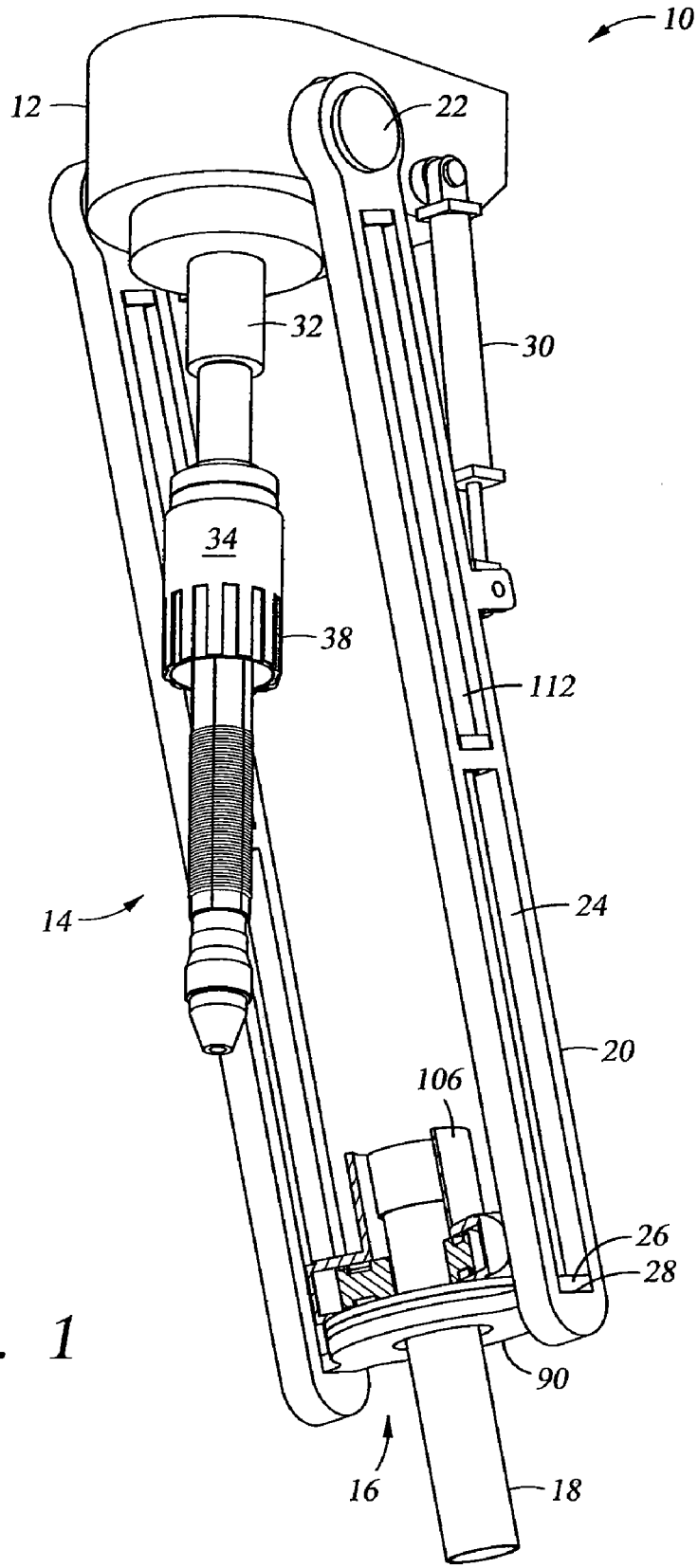
FIG. 1 is a perspective view of one embodiment of a casing running and drilling system.

FIG. 1 is a perspective view illustrating one embodiment of a casing running and drilling system 10 of the invention. The casing running and drilling system 10 includes a top drive 12 suspended on a drilling rig (not shown) above a borehole (not shown), a grapple tool or spear 14 for engagement with the interior of a tubular such as casing 18, and a clamping head 16 engageable with the exterior of the casing 18. In general, the top drive 12 provides rotation to drilling elements connectable therewith.

The clamping head 16 mounts on a pair of mechanical bails 20 suspended from a pair of swivels 22 disposed on the top drive 12. The bails 20 are generally linear segments having axial, longitudinally disposed slots 24 therein. A pair of guides 26 extends from the clamping head 16 into the slots 24 and provides support for the clamping head 16. As shown in FIG. 1, the pair of guides 26 rest against the base 28 of the slots 24 when the clamping head 16 is in a relaxed position. In one embodiment, the guides 26 are adapted to allow the clamping head 16 to pivot relative to the bails 20. Bails 20 further include a pair of bail swivel cylinders 30 connected between the bails 20 and the top drive 12 to swing the bails 20 about the pivot point located at the swivels 22. The bail swivel cylinders 30 may be hydraulic cylinders or any suitable type of fluid operated extendable and retractable cylinders. Upon such swinging motion, the clamping head 16 likewise swings to the side of the connection location and into alignment for accepting or retrieving the casing 18 that is to be added to the string of casing in the borehole.

The spear 14 couples to a drive shaft 32 of the top drive 12 and is positioned between the bails 20 and above the clamping head 16 when the clamping head 16 is in the relaxed position. During make up and drilling operations, the clamping head 16 moves from the position shown in FIG. 1 to the position shown in FIG. 6 such that the spear 14 is in alignment with the casing 18. The spear 14 then enters into the open end of the casing 18 located within the clamping head 16, as shown in detail in FIGS. 2B and 7.

Figure 2A:
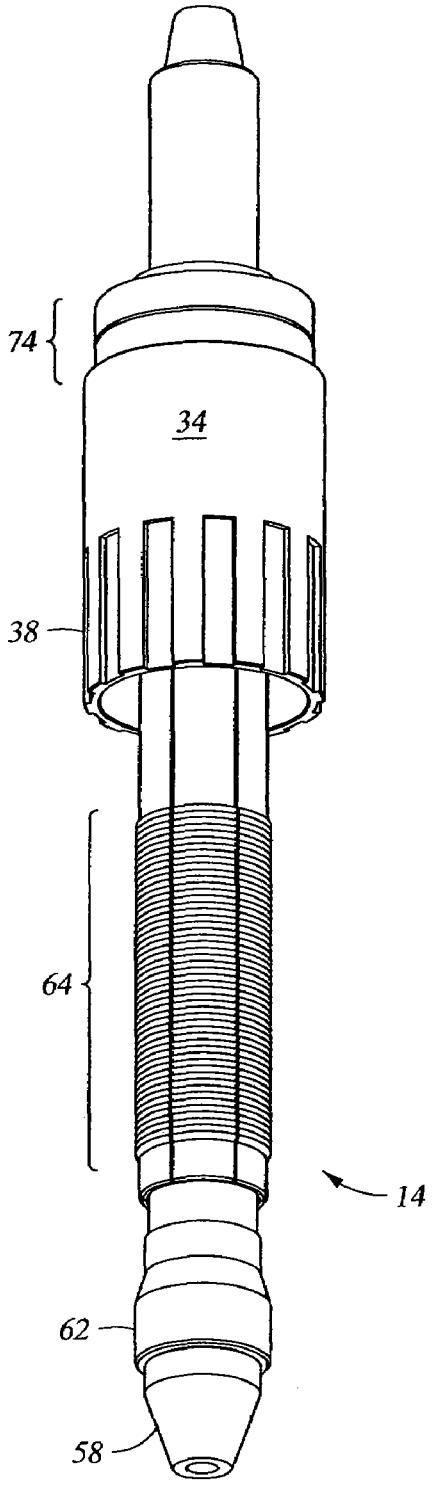
FIG. 2A is a perspective view of one embodiment of a spear.
Figure 2B:
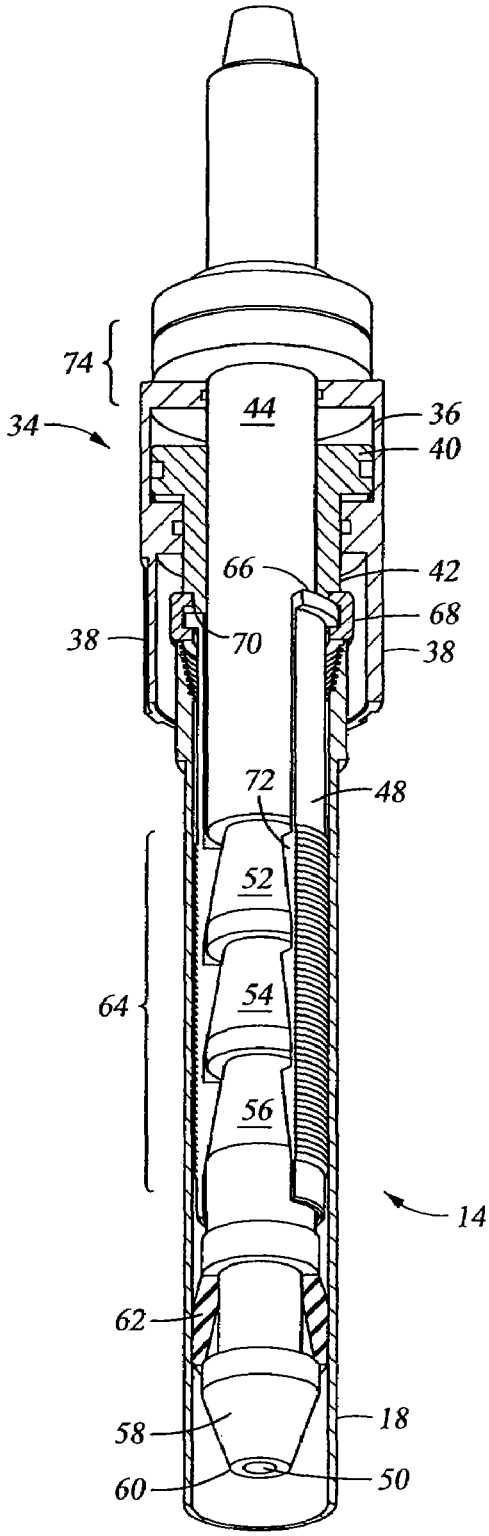
FIG. 2B is a partial sectional view of the spear of FIG. 2A.

FIGS. 2A and 2B show perspective and partial cross-sectional views, respectively, of one embodiment of the spear 14. The spear 14 generally includes: a housing 34 defining a piston cavity 36 and a cup shaped engagement member 38 for engagement with the clamping head 16; a piston 40 disposed within the piston cavity 36 and actuatable therein in response to a pressure differential existing between opposed sides thereof; a slip engagement extension 42 extending from the piston 40 and outwardly of the piston cavity 36 in the direction of the clamping head 16 (shown in FIG. 7); a mandrel 44 extending through the piston cavity 36 and piston 40 disposed therein; and a plurality of slips 48 disposed circumferentially about the mandrel 44 and supported in place by the slip engagement extension 42 and connector 68. The spear 14 enables controlled movement of the slips 48 in a radial direction from and toward the mandrel 44 in order to provide controllable loading of the slips 48 against the interior of the casing 18, as further described herein.

Referring principally to FIG. 2B, the mandrel 44 defines a generally cylindrical member having an integral mud flow passage 50 therethrough and a plurality of conical sections 52, 54, 56 (in this embodiment three conical sections are shown) around which the slips 48 are disposed. A tapered portion 58 at the lower end of the mandrel 44 guides the spear 14 during insertion into the casing 18. An aperture end 60 forms the end of the mud flow passage 50 such that mud or other drilling fluids may be flowed into the hollow interior or bore of the casing 18 for cooling the drill shoe and carrying the cuttings from the drilling face back to the surface through the annulus existing between the casing 18 and borehole during drilling. The spear 14 includes an annular sealing member 62 such as a cap seal disposed on the outer surface of the mandrel 44 between the lowermost conical section 56 and the tapered portion 58. The annular sealing member 62 enables fluid to be pumped into the bore of the casing 18 without coming out of the top of the casing 18.

The mandrel 44 interfaces with the slips 48 to provide the motion and loading of the slips 48 with respect to the casing 18 or other tubular being positioned or driven by the top drive 12. Referring still to FIG. 2B, each of the slips 48 include a generally curved face forming a discrete arc of a cylinder such that the collection of slips 48 disposed about the mandrel 44 forms a cylinder as shown in FIG. 2A. Each slip 48 also includes on its outer arcuate face a plurality of engaging members, which in combination serve to engage against and hold the casing 18 or other tubular when the top drive 12 is engaged to drill with the casing 18. In one embodiment, the engaging members define a generally parallel striations or wickers 64. At the upper end of each slip 48 is an outwardly projecting lip 66, which engages with the slip engagement extension 42 by way of a connector 68. In this embodiment, the connector 68 is a c-shaped flange that couples the slip engagement extension 42 to the slips 48 by receiving the lip 66 of the slips 48 and a generally circumferential lip 70 on the piston extension 42. Thus, the position of the slips 48 relative to the conical sections 52, 54, 56 on the mandrel 44 is directly positioned by the location of the piston 40 in the piston cavity 36. The slips 48 further include a plurality of inwardly sloping ramps 72 on their interior surfaces that are discretely spaced along the inner face of the slips 48 at the same spacing existing between the conical sections 52, 54, 56 on the mandrel 44. Each ramp 72 has a complementary profile to that of the conical sections 52, 54, 56. In a fully retracted position of the slips 48, the greatest diameters of the conical sections 52, 54, 56 are received at the minimum extensions of the ramps 72 from the inner face of the slips 48, and the minimum extensions of the conical sections 52, 54, 56 from the surface of the mandrel 44 are positioned adjacent to the greatest inward extensions of the ramps 72.

Figure 7:
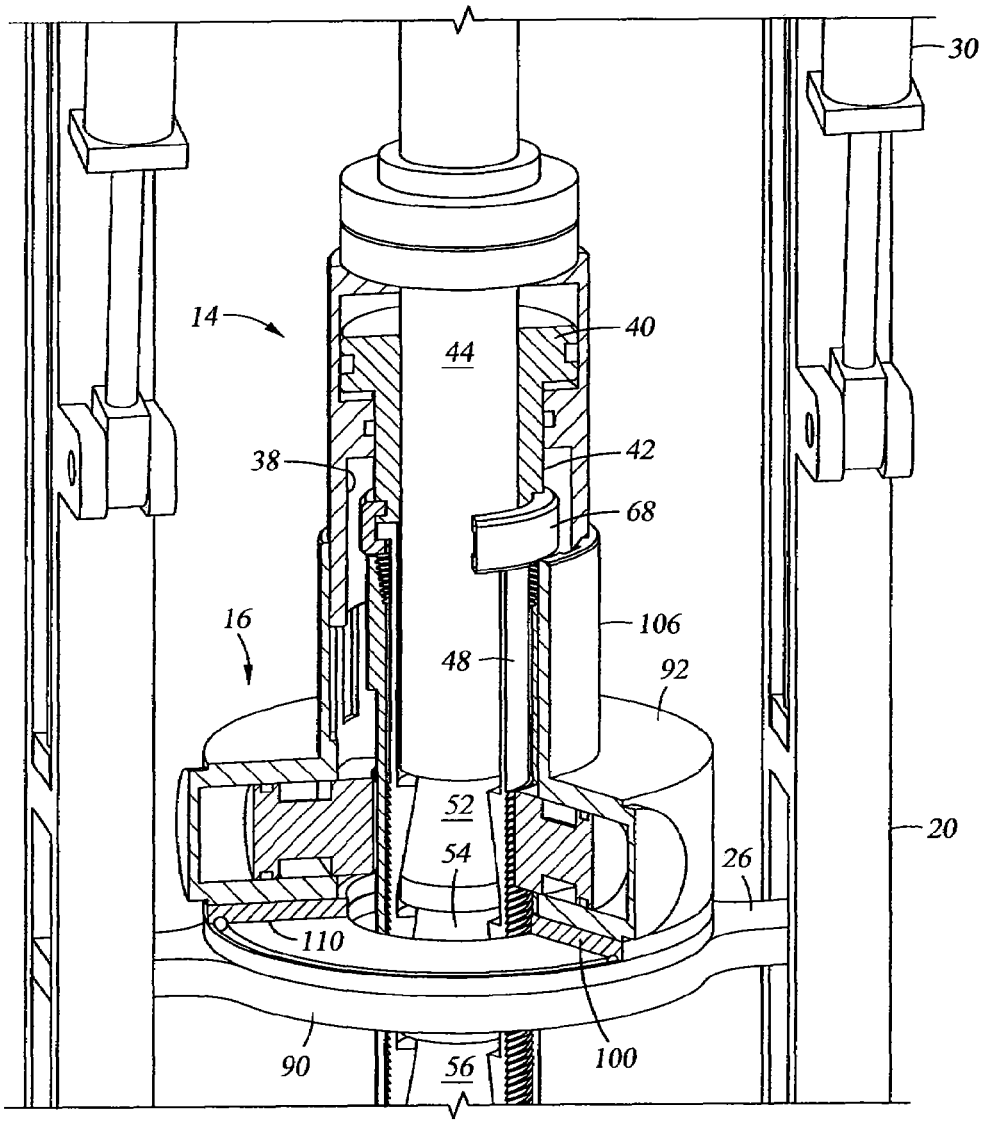
FIG. 7 is a partial sectional view showing the operation of the casing running and drilling system.

To actuate the slips 48 outwardly and engage the inner face of a section of the casing 18, the piston 40 moves downwardly in the piston cavity 36, thereby causing the ramps 72 of the slips 48 to slide along the conical sections 52, 54, 56 of the mandrel 44, thereby pushing the slips 48 radially outwardly in the direction of the casing wall to grip the casing 18 as shown in FIGS. 2B and 7. To actuate the piston 40 within the piston cavity 36, air is supplied thereto through a rotary union 74, which enables the placement of a stationary hose (not shown) to supply the air through the mandrel 44 and into the piston cavity 36 on either side of the piston 40, selectively. By releasing the air from the upper side of the piston 40, and introducing air on the lower side of the piston 40, the slips 48 swing inwardly to the position shown in FIG. 2A. The load placed on the casing 18 by the slips 48 may be controlled to sufficiently grip the casing 18 but not exceed the strength of the casing 18 against plastic deformation or rupture by selectively positioning the piston 40 in the piston cavity 36 based upon known conditions and qualities of the casing 18. Radial force between the slips 48 and the casing 18 may increase when the casing 18 is pulled or its weight applied to the spear 14 since the slips 48 are pulled downwards and subsequently outwards due to the ramps 72 and the conical sections 52, 54, 56.

Figure 4:
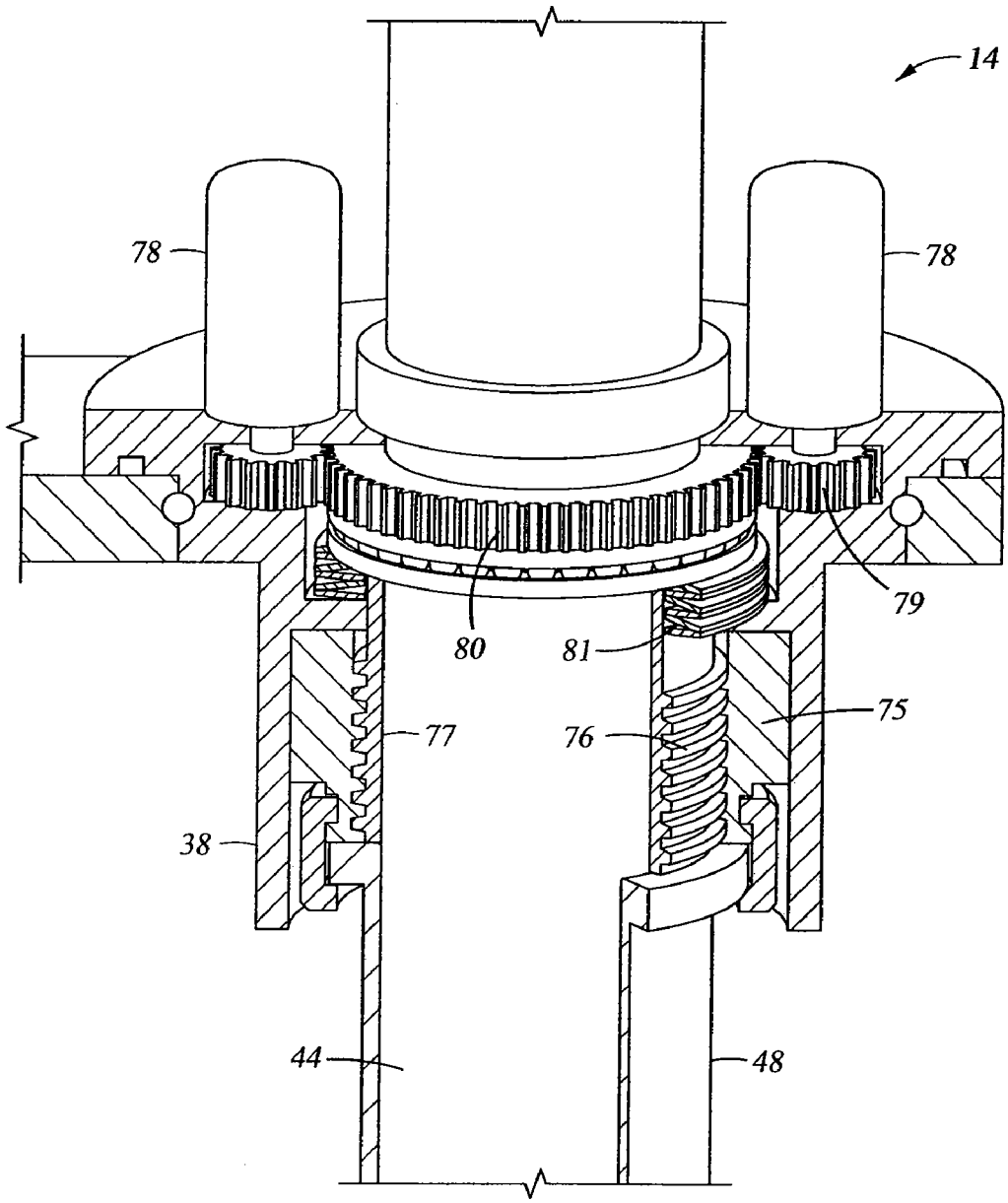
FIG. 4 is a partial sectional view of another embodiment of a spear.

FIG. 4 illustrates an alternative embodiment of a spear 14 that replaces the piston 40 and piston cavity 36 used as an actuator in the embodiment shown in FIG. 2B with a spindle drive in order to provide an actuator that imparts relative movement between slips 48 and mandrel 44. A plurality of threads 76 on a spindle 77 thread into a threaded nut 75 grounded against rotation at a location remote from the conical sections (not shown). By rotating the spindle 77, the threaded nut 75 and the slips 48 coupled thereto may move upwardly or downwardly with respect to the mandrel 44, thereby causing extension or retraction of the slips 48 due to the interactions between ramps 72 and conical sections 52, 54, 56 as described above and illustrated in FIG. 2B. The spindle 77 rotates by activating and controlling spindle drive motors 78. The motors 78 rotate pinions 79 that mesh with a gear 80 of the spindle 77 and provide rotation thereto in order to control the grip that the slips 48 have on the casing (not shown). Springs 81 and relative axial movement between the gear 80 and pinions 79 permit downward movement of the slips 48 when the casing 18 is pulled or its weight applied to the spear 14. In this manner, radial force between the slips 48 and the casing 18 may increase since the slips 48 are pulled downwards and subsequently outwards due to the ramps 72 and the conical sections 52, 54, 56.

Figure 5:
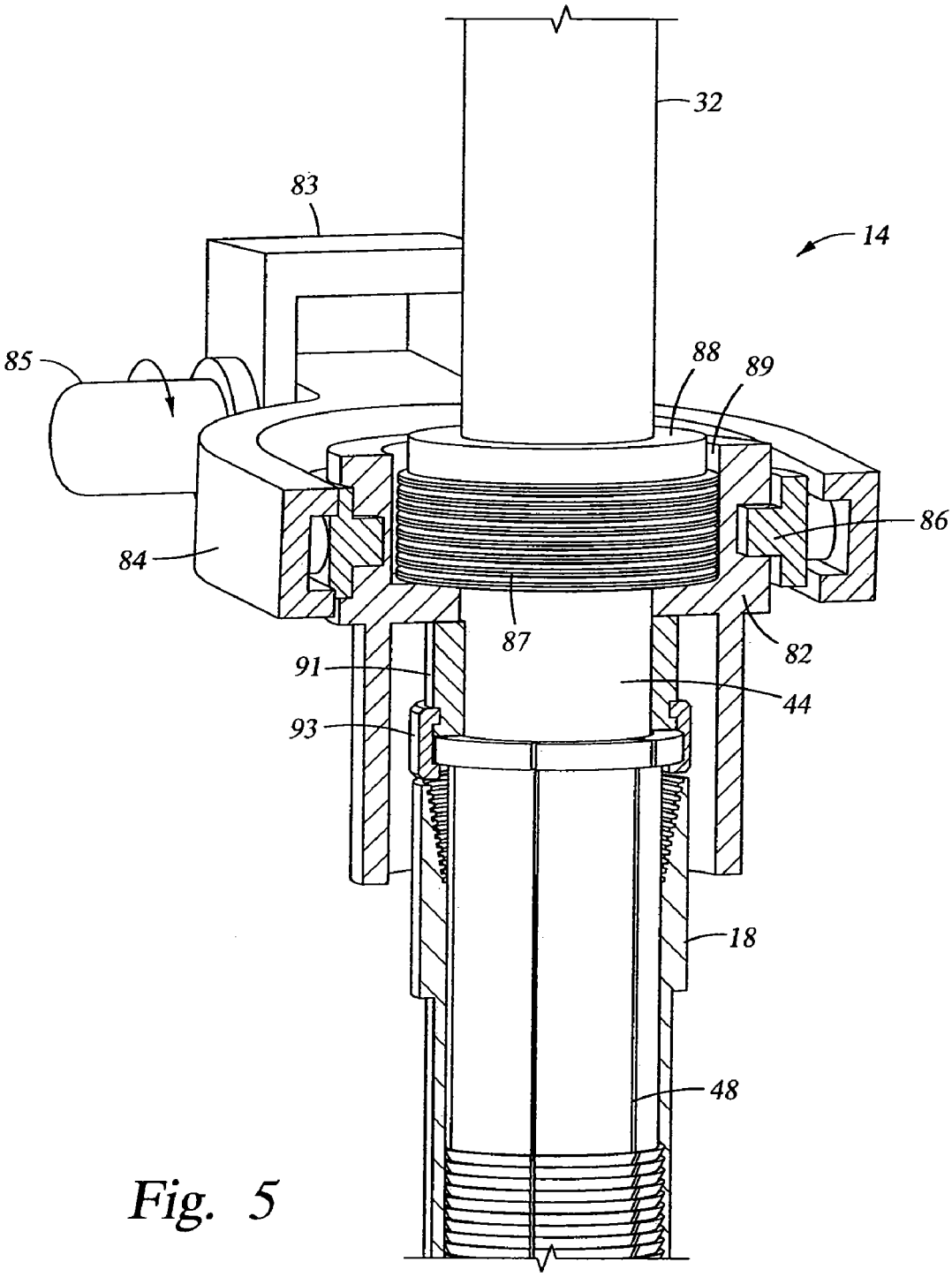
FIG. 5 is a partial sectional view of another embodiment of a spear.

FIG. 5 shows another embodiment of a spear 14 that includes a housing 82 held in a fork lever 84 coupled to a base 83 to provide a swivel. A sliding ring 86 couples the housing 82 to the fork lever 84. The base 83 attaches to a portion of the top drive (not shown) such that movement of the fork lever 84 provides relative movement between a mandrel 44 of the spear 14 connected to the top drive and slips 48 coupled to the fork lever 84. A bushing 91 connected to the slips 48 using a connector 93 is provided to couple the slips 48 and the housing 82. A spring 87 held in a retainer 89 formed above the housing 82 acts on an annular flange 88 of the shaft 32 to bias the slips 48 downward relative to the mandrel 44. A swivel drive 85 positions the fork lever 84 in the swivel position shown in FIG. 5 such that the spring 87 urges the slips 48 downward with respect to the mandrel 44, thereby causing loading of the slips 48 against the interior of the casing 18 as ramps 72 on the inside of the slips 48 engage against conical sections 52, 54, 56 of the mandrel 44 as described above and illustrated in FIG. 2B. If the swivel drive 85 actuates in the direction opposite of the arrow, then the spring 87 compresses against the annular flange 88 due to the fork lever 84 and housing 82 being raised relative to the mandrel 44. Raising the housing 82 also raises the slips 48 coupled thereto relative to the mandrel 44 in order to allow the slips 48 to slide inwardly. Therefore, the swivel drive 85 operates as another example of an actuator used to engage and disengage the slips 48.

Figure 3:
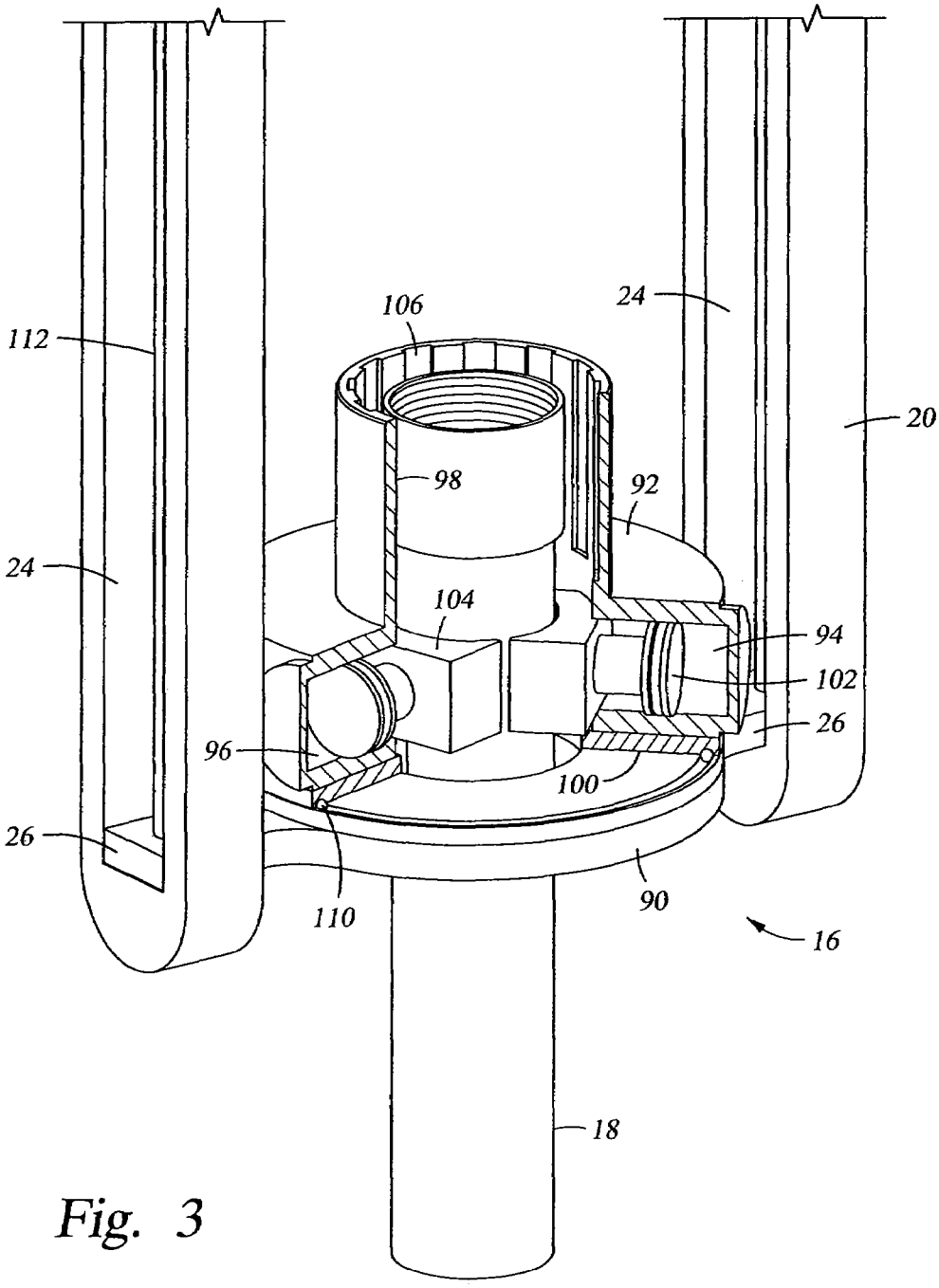
FIG. 3 is a partial sectional view of one embodiment of a clamping head.

FIG. 3 illustrates a partial sectional view of the clamping head 16 shown in FIGS. 1 and 7. The clamping head 16 generally includes a clamping head carrier 90 upon which a housing 92 of the clamping head 16 is positioned for rotation therewith. A bearing face 100 and a bearing 110 enable rotation of the housing 92 on the carrier 90. The clamping head carrier 90 includes the two guides 26 which extend into the slots 24 in the opposed bails 20. Within the slots 24 in the bails 20 are positioned lifting cylinders 112, one end of which are connected to the guides 26 and the second end of which are grounded within the bails 20, to axially move the clamping head assembly 16 along the bails 20.

The clamping head housing 92 includes a plurality of hydraulic cylinders 94, 96, preferably three (two are shown), disposed about and radially actuatable toward the centerline of a tubular receipt bore 98 into which pipe, casing 18 and the like may be selectively positioned. Hydraulic pistons 102, 104 disposed within the hydraulic cylinder cavities 94, 96 move inward in a radial direction toward the axis of the casing 18 and clamp the casing 18 therein. In this manner, the hydraulic pistons 102, 104 are hydraulically or pneumatically actuatable within the cylinders 94, 96 to engage or release the casing 18 positioned in the receipt bore 98. Hydraulic or pneumatic pressure may be transmitted to the cylinders 94, 96 using a rotary union (not shown) similar to the rotary union 74 of the spear 14. The upper end of the housing 92 of the clamping head 16 includes a female splined portion 106 which mates with a male splined portion of the cup shaped engagement member 38 (shown in FIG. 1). The engagement between the female splined portion 106 of the clamping head 16 and the cup shaped engagement member 38 of the spear 14 allows torque transfer from the spear 14 to the clamping housing 92 such that the clamping housing 92 that grips the casing 18 rotates on top of the clamping head carrier 90 during rotation of the spear 14.

Figure 6:
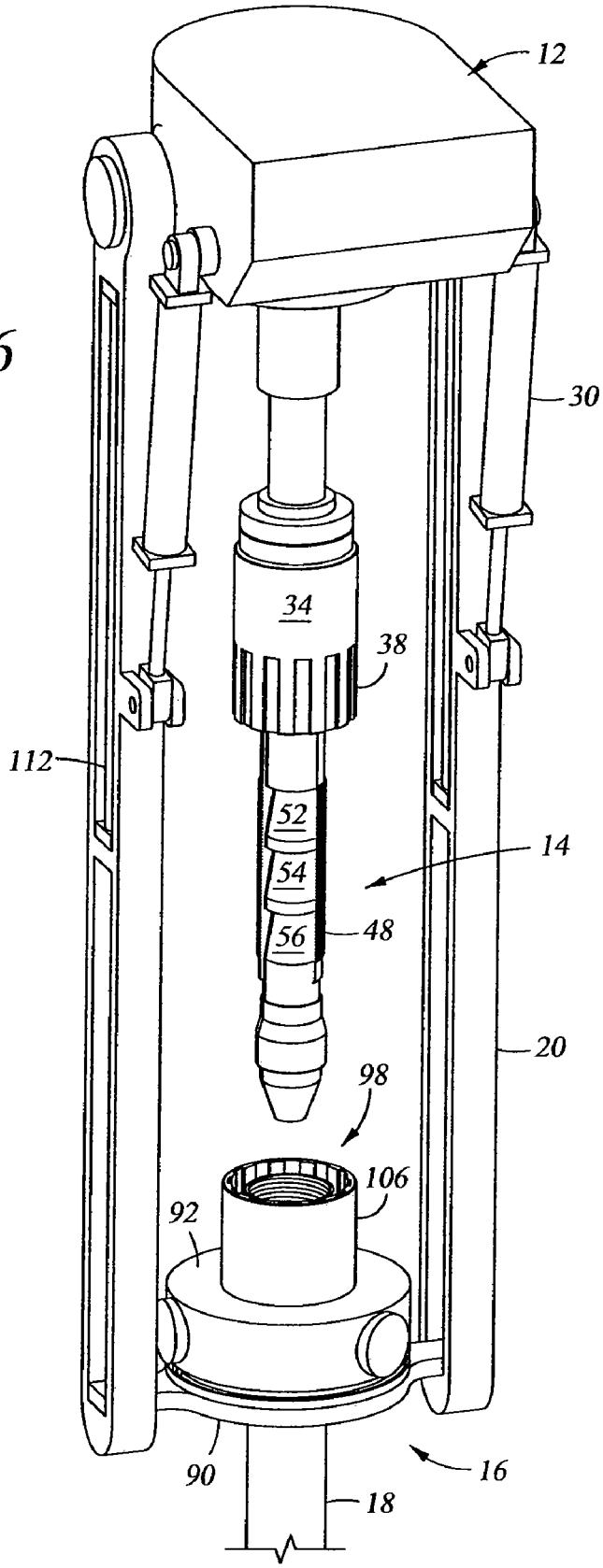
FIG. 6 is a perspective view showing the alignment of a casing under a spear supported by a clamping head.
Figure 6A:
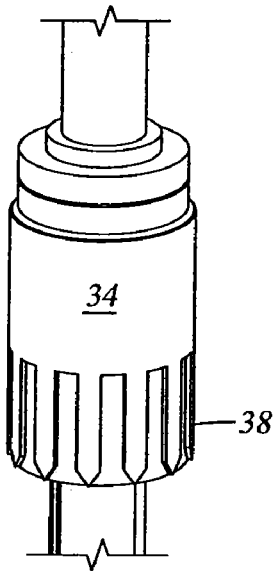
FIG. 6A is a partial view of one embodiment of a spline for an engagement member of a spear.

To begin a make up operation, the bails 20 are positioned as shown in FIG. 1 by the bail swivel cylinders 30. The clamping head 16 is open, i.e., the hydraulic pistons 102, 104 are retracted and the clamping head 16 is generally near its lowest position within the bails 20. With the clamping head 16 in the open position, the casing 18 can be fed from the rig's v-door (not shown). Once the casing 18 is inserted into the clamping head 16, the pistons 102, 104 of the clamping head 16 are extended to engage the casing 18. While not shown, the positioning of the casing 18 into the clamping head 16 can be performed by positioners and the positioning thereof can be monitored by means of sensors (mechanical, electrical or pneumatic sensors). Next, the bail swivel cylinders 30 actuate to position the bails 20 and the casing 18 in vertical alignment with the top drive 12 and the spear 14 as shown in FIG. 6. Actuating the lifting cylinders 112 raises the clamping head 16 and the casing 18 until the splined portion 106 of the clamping head 16 engages with the mating splines of the engagement member 38 as shown in FIG. 7. To aid in the insertion, the leading ends of the splines may be cut in a generally helical manner to affect the rotational alignment of the mating splines without the need for rotation of the spear 14, as shown in FIG. 6A. The entire top drive 12 is then lowered downwardly until the pin end of the casing 18 is close to the box of the casing string fixed in the spider on the rig floor (not shown). As the pin end of the casing 18 approaches the box of the casing string below, the top drive 12 stops its downward travel and the clamping head 16 and the casing 18 is lowered downward by actuating the lifting cylinders 112 while the drive shaft 32 of the top drive 12 rotates the spear 14, the clamping head 16 engaged with the spear 14, and the casing 18 gripped by the clamping head 16. In this manner, the pin end of the casing 18 stabs into the box of the casing string. After stabbing, the top drive 12 makes up the threaded connection to the necessary torque. To facilitate torque transmission, the tubular contact surface of the pistons 102, 104 may include wickers, teeth, or gripping members. During the make up operation, the lifting cylinders 112 move the clamping head 16 downwardly to compensate for the axial movement of the casing 18 caused by the make-up of the threaded connection. Thus, a preset force (pressure) applied by the lifting cylinders 112 to the clamping head 16 protects the threads of the connection from overloading. The pistons 102, 104 of the clamping head 16 release the casing 18 after the connection is made up.

Thereafter, the spear 14 is actuated to push the slips 48 down and cause the slips 48 to clamp the casing 18 from the inside. Once the spear 14 clamps the inside of the casing 18, the top drive 12 carries the weight of the newly extended casing string and lifts the casing string up relative to the spider (not shown), thereby releasing the casing string from the spider. After the casing string is released from the spider, the top drive 12 moves down and drilling with the casing commences. During drilling, the slips 48 of the spear 14 continue to grip the inside of the casing 18 to support the load and any torsional force from drilling as necessary.

In some drilling operations, it may be necessary to set the casing string under pressure while drilling. To this end, the present invention provides one or more ways to transfer pressure from the top drive 12 to the casing 18. In one aspect, the clamping head 16 may be used to clamp the casing 18 and transfer a thrust/rotational load to the casing drill string. Rotation load is provided by the top drive 12 to the casing string due to the spline engagement between the clamping head 16 and the cup shaped engagement member 38 of the spear 14. From this configuration, the thrust load may be supplied to the casing 18 either from the top drive 12 or the lifting cylinders 112. In one embodiment, the top drive 12 supplies the thrust load, which is transferred to the engagement member 38, to the clamping head 16, and then to the casing 18 clamped therein. Alternatively, the thrust load may be supplied by the lifting cylinders 112 pushing the clamping head 16 downward along the slots 24 in the bails 20.

Figure 7A:
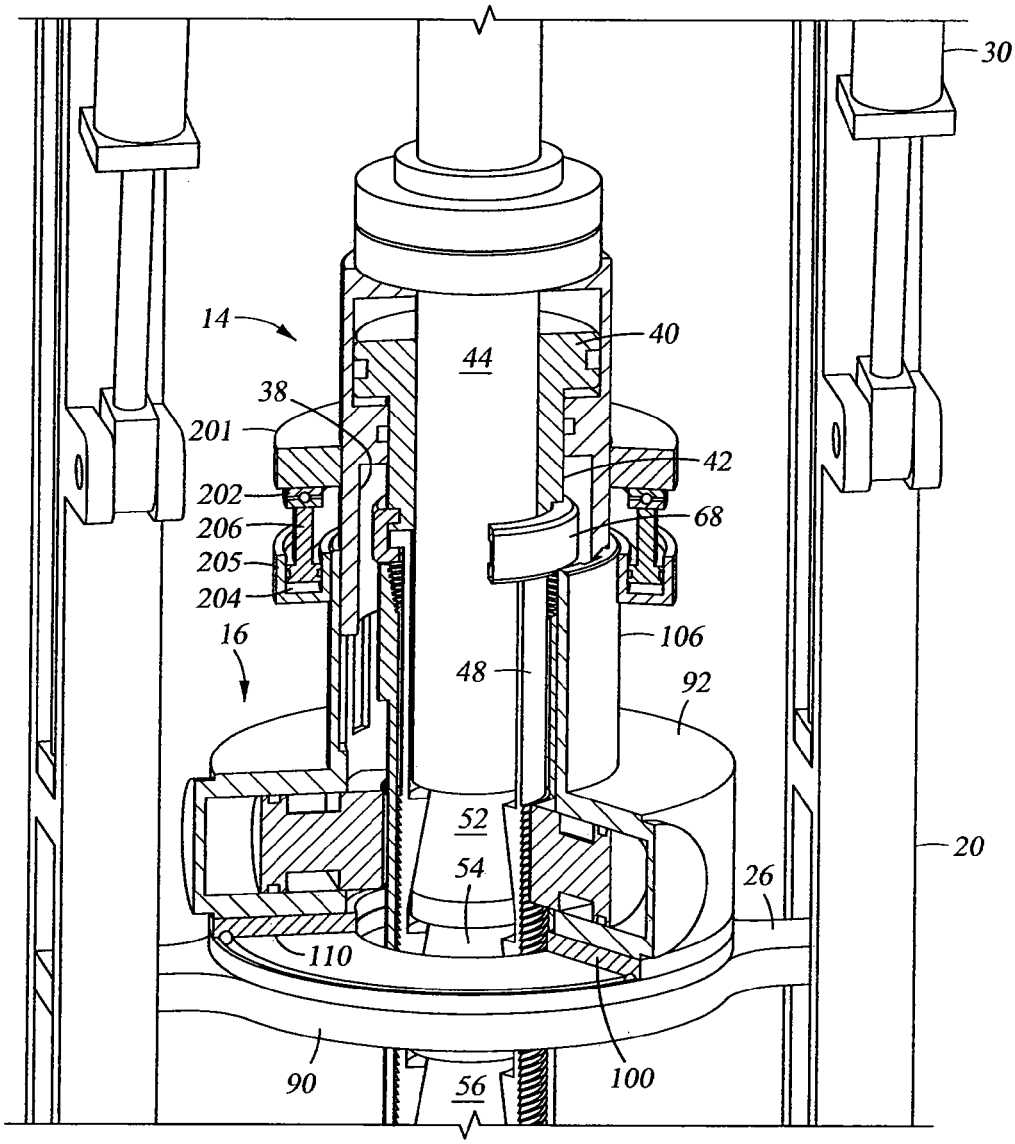
FIG. 7A shows another embodiment of a casing running and drilling system.

In another embodiment still, the thrust load may be applied by placing a separating force between male and female splined cups, as shown in FIG. 7A. In FIG. 7A, the upper cup includes a shoulder 201 and the bottom cup includes a shoulder 205 with a plurality of pistons 206 attached thereto. The pistons 206 contract or extend based on applied pressure in the cavity 204. As the pistons 206 are extended, the thrust bearing 202 attached to the piston 206 comes into contact with a lower surface of the shoulder 201. With increased pressure in cavity 204 the applied force on the lower surface is increased. This load is transmitted through to the mandrel 44 and the casing 18 thereby holding the spear 14 in position.

Although embodiments of the present invention disclose a hydraulic or fluid operated spear, aspects of the present invention are equally applicable to a mechanically operated spear. In this respect, the mechanical spear may be adapted for use in compression without releasing the casing.

In another embodiment, the spear may optionally include a valve for filling up and circulating fluid in the casing. An exemplary valve is disclosed in U.S. patent application Publication No. 2004/0000405, filed on Jun. 26, 2002, which application is assigned to the same assignee of the present application. In one example, the valve may include a valve body and a valve member disposed in the valve body. The valve member is movable between an open and closed position and includes an aperture therethrough. The valve further includes a pressure relief member disposed in the aperture, whereby at a predetermined pressure, the pressure relief member will permit fluid communication.

The spear of the present invention may be configured for specific utility to enable the capture of casing of variable geometry and size, from large casing used at the beginning of drilling down to relatively small diameter casing, with a single set of slips, which was not practical in the prior art. In particular, where the casing is used for drilling, substantial weight must be suspended from the slips, such weight comprising the accumulated effective weight of several thousand feet of casing suspended in the borehole, less any buoyancy offset caused by the presence of drilling fluids in the borehole. Where a single set of slips is used for casing of different specified diameters, the slips have only a set area over which they may engage the casing, such that as the casing becomes larger in diameter, and thus correspondingly heavier, the unit of mass per unit area of slip increases significantly. In the prior art, this was compensated for by increasing the load of the slips on the casing, resulting in scarring of the casing surface and/or plastic deformation or rupture of the casing.

Figure 9:
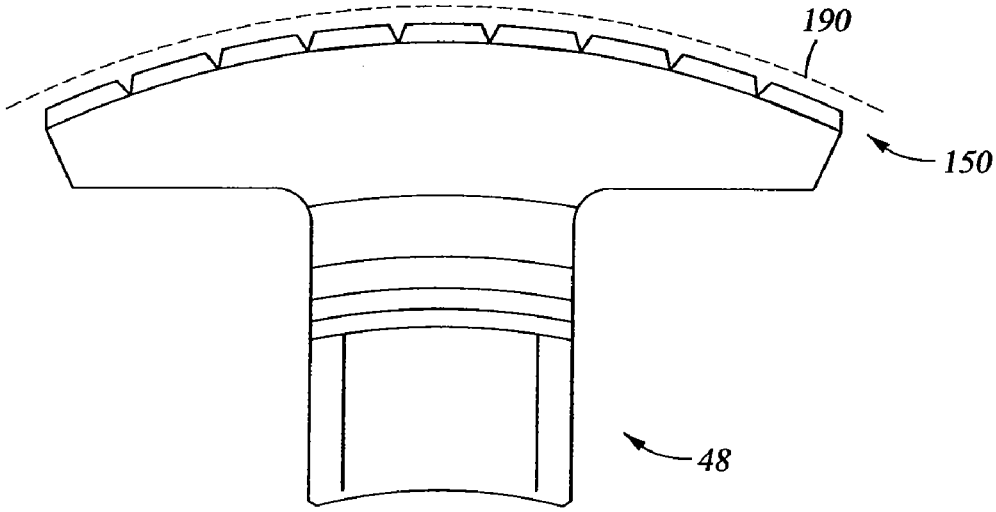
FIG. 9 is a cross-sectional view of a slip having wickers disposed thereon and positioned in casing of variable inner diameter.
Figure 10A:
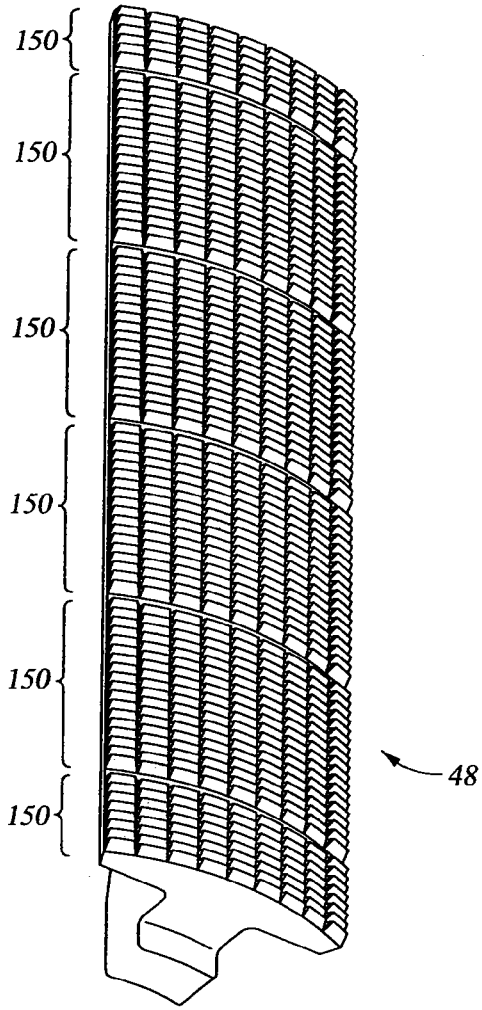
FIGS. 10A and 10B are perspective and cross-sectional views, respectively, of a slip having variable height wickers disposed thereon, with higher wickers disposed on the outer edges of the slip.
Figure 10C:
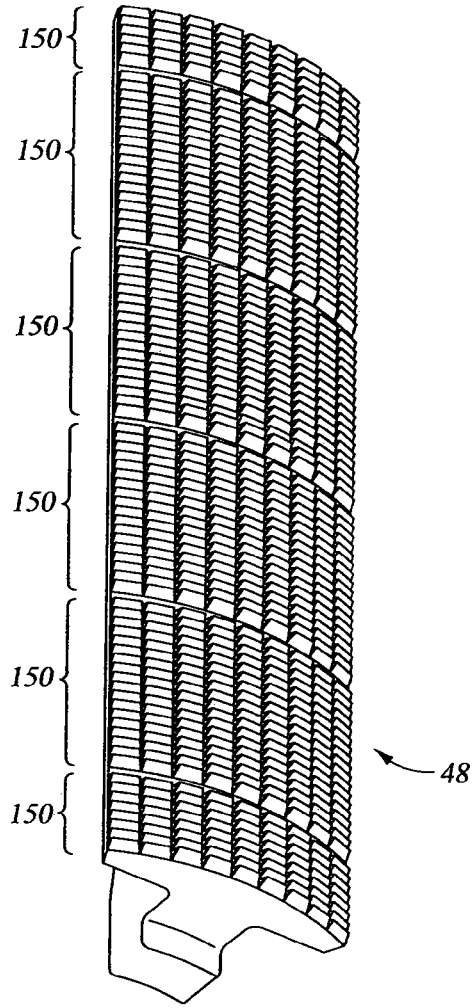
FIGS. 10C and 10D are perspective and cross-sectional views, respectively, of a slip having variable height wickers disposed thereon, with higher wickers disposed on the center of the slip.

FIGS. 8A, 10A and 10C are perspective views of slips 48 having wickers 150 disposed thereon. The axial load is distributed among a plurality of wickers 150, each of which includes a crest portion which is engageable against the casing surface. The crest portion includes a relatively sharp edge which is engageable through the scale or rust typically found on the inner surface of the casing 18. In one aspect, the wickers 150 are configured, as shown in profile in FIGS. 8B, 9, 10B and 10D, to include crest portions located various heights. In this respect, where the load is less, fewer wicker crest portions are engaged to carry the load. As the outward load increases, more wicker crest portions are recruited to support the load. FIG. 9 shows a dashed arc 190 representing the potential variation in height of wickers 150 across the face of the slip 48. By having wickers 150 with crest portions at multiple heights from the face of the slips 48, a spear 14 may be equipped with a single set of slips 48 to load and drill with casing 18 of a variety of sizes without overloading or tearing into the circumferential inner face of the casing 18.

FIG. 8A optionally includes vertical wickers 152 of variable lengths and heights. Generally, the wickers 152 are configured to include a crest portion positioned exteriorly of, and spaced from, the outer surface of the slips 48. In the embodiment shown in FIG. 8A, the slip 48 includes two outer full length wickers 154 surrounding three shorter length wickers 156, 158, 160 disposed therebetween. The wickers 156, 158, 160 in the center may have a height slightly greater than that of the outer wickers 154. Depending on the applied load, the number of wickers 152 recruited for duty may be varied. For example, only the center wickers 156, 158, 160 may be engaged for smaller loads, while all the wickers 152 may be recruited for heavier loads.

Figure 10B:
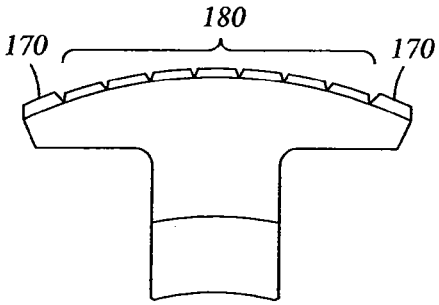
Figure 10D:
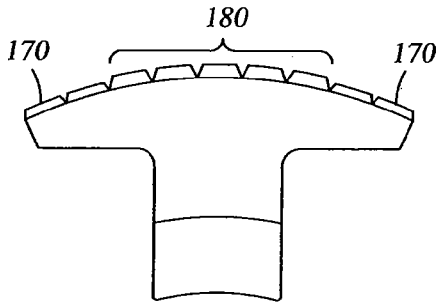

Referring now to FIGS. 10A-10D, there is shown a plurality of wickers 150 having variable height. As shown in FIGS. 10A and 10B, the height of the outer column of wickers 170 is slightly greater than the inner columns of wickers 180. In FIGS. 10C and 10D, the inner columns of wickers 180 have a height slightly greater than the outer columns of wickers 170. The arrangement of slips 48 within a single tool may include the same wicker configuration for each slip 48 or may include slips 48 varying between two or more different wicker configurations. As an example, the tool may include slips 48 having the configuration of either FIG. 8A, 10A or 10C. Alternatively, the tool may include slips 48 of FIGS. 10A and 10C. Still further, the tool may include slips 48 of FIGS. 8A, 10A and 10C, or any combination of these or other designs.

Figure 11:
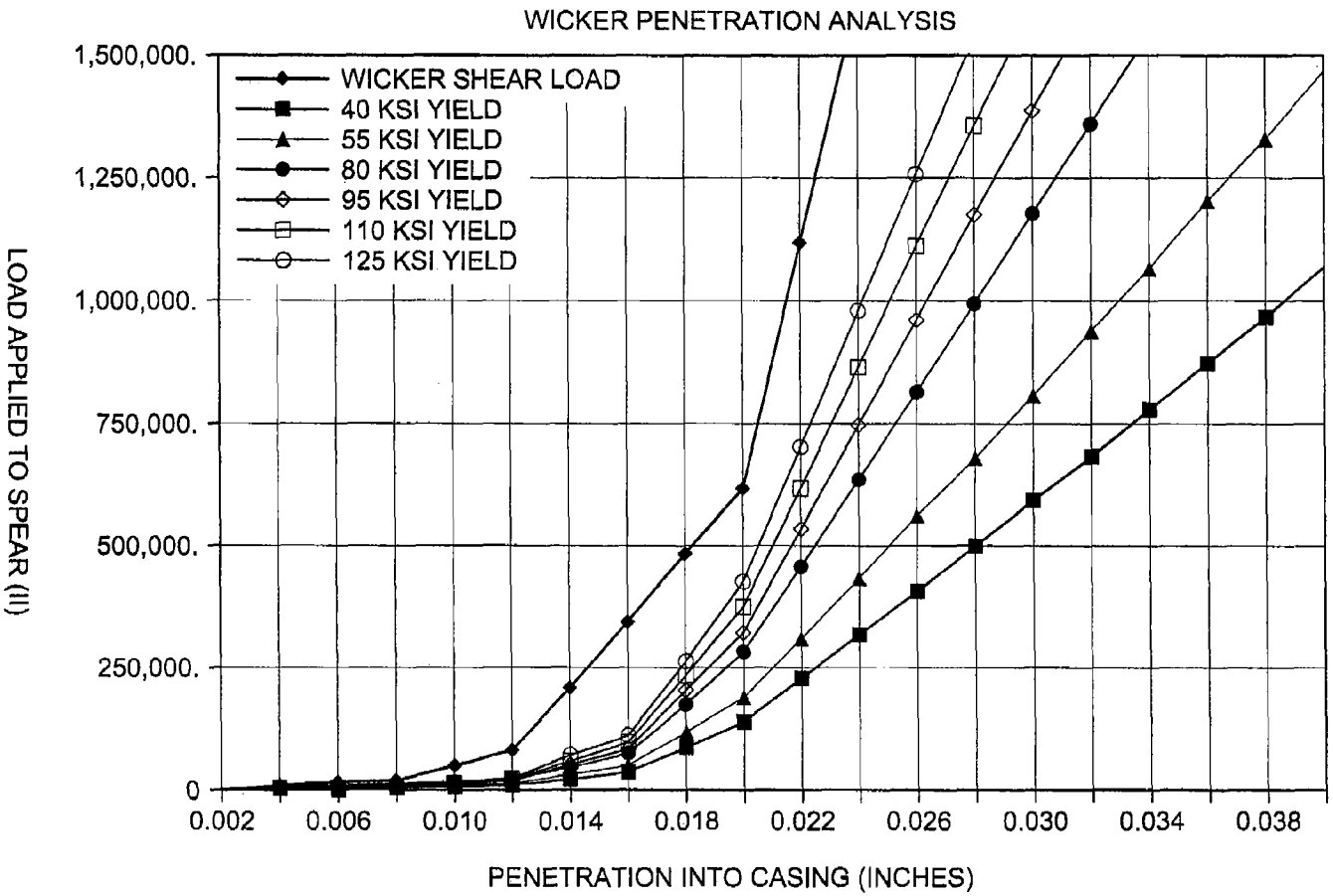
FIG. 11 is a graph comparing the load required to penetrate various grades of casing and load to shear out the casing versus the actual penetration depth resulting from applied load.

Referring back to FIGS. 10A and 10C, while only two varying heights are shown, more wickers 150 of variable heights are contemplated herein. As an example, the first wicker may be of a height H, extending between the base of the wicker plate or the base of the slip loading face, and terminating in a generally sharp edge. The second wicker may be have a height on the order of 80% of H, the third wicker may have a height on the order of 75% of H, etc. Thus, when the slips are biased against the casing inner surface, the wicker of the first height H will engage the casing and penetrate the surface to secure the casing in place. If the casing begins to move relative to the slips 48, the relative movement will cause the first wicker to penetrate deeper into the casing until the wickers of the second height engage against the inner face of the casing to provide additional support. In this respect, capacity to retain the casing may be increased without increasing the pressure on the casing. The wickers will rapidly establish a stable engagement depth, after which further wicker engagement is unlikely. Preferably, the wickers are distributed in height throughout the slip, both in the individual striations, as well as the wickers on the wicker plate, to enable relatively fast equilibrium of wicker application. As the number of wickers increases, the collective wicker shear load is designed to stay below the load required to shear any number of wickers that has penetrated the highest yield strength casing. This is graphically represented in FIG. 11.

Referring again to FIG. 8, the wickers 150, 152 on the wicker plates are located intermediate individual sets of striations and generally perpendicular thereto, and are generally evenly spaced circumferentially across the face of the slip 48 in the gaps between adjacent sets of striations. The wickers 150, 152 may vary in height in multiple positions as described above in reference to FIGS. 10A-10D. Preferably, the tallest wickers are located toward, but not at the edge of the slip 48 as shown in FIG. 9, with correspondingly shorter wickers located circumferentially inwardly and outwardly therefrom. As a result, whether the casing is smaller in diameter or larger in diameter from the nominal design size, the same tallest wickers will engage the casing.

In this manner, aspects of the present invention provide a spear with increased capacity to carry more casing weight with minimal or no damage to the casing or slips. In one embodiment, the capacity may be increased without the use of hydraulics. Because the wickers vary in height and quantity, they penetrate a variety of casing IDs with the same applied load from the casing to the same depth. The wickers may function with or without the presence of scale. In one aspect, the load required to penetrate various grades of casing is designed to remain below the load to shear out the casing by accounting for the actual penetration depth resulting from any applied load. It must be noted that aspects of the present invention may apply to any gripping tool, mechanical or hydraulic, such as a spear, torque head, overshot, slip, tongs, or other tool having wickers or teeth as is known to a person of ordinary skill in the art.

Figure 12:
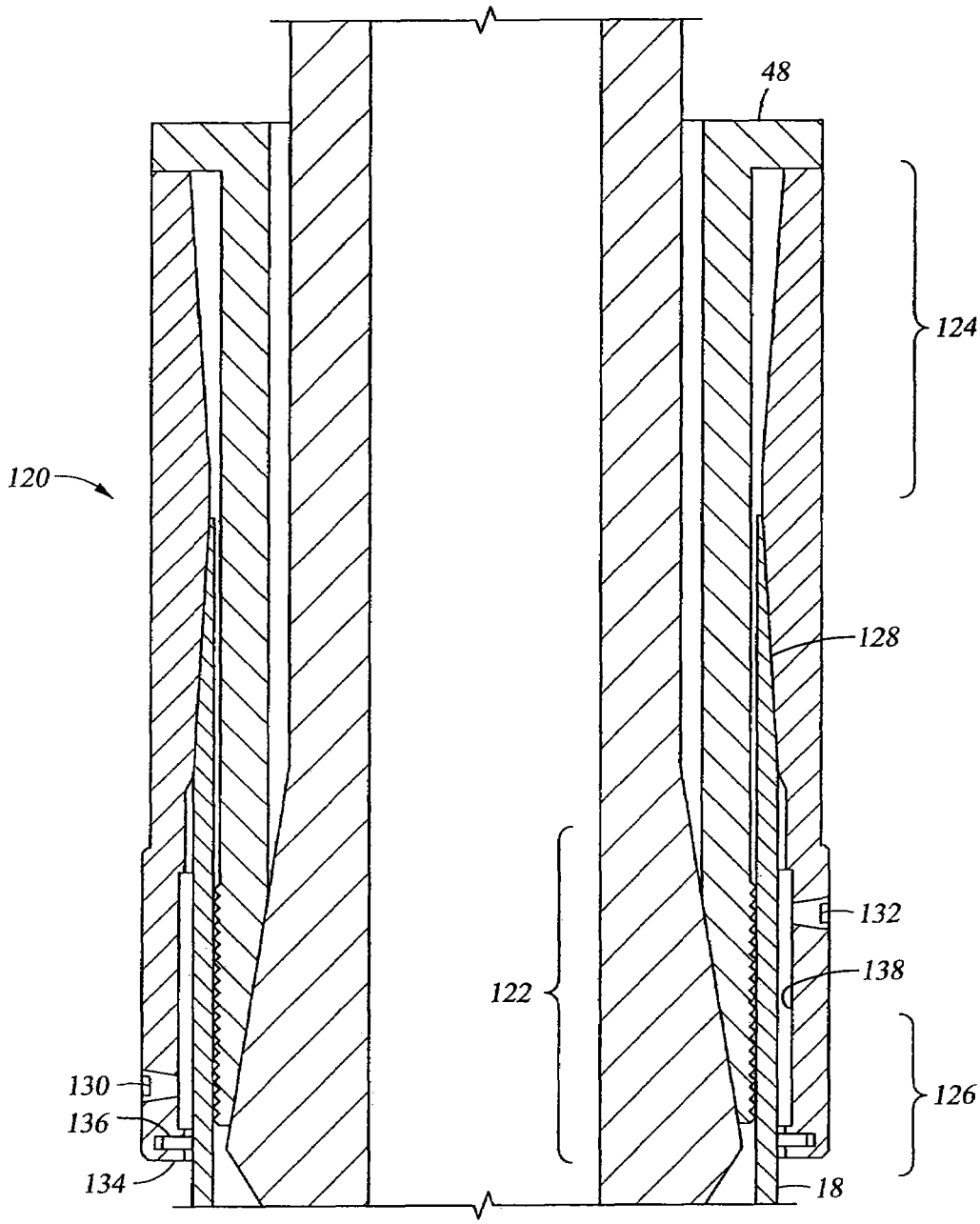
FIG. 12 is a sectional view of a collar disposed on a piece of casing.

In another aspect, FIG. 12 illustrates a casing collar 120 that may be used with embodiments described herein to provide a rigid exterior surface to the casing 18 opposite the loading position of the slips 48 therein, thereby enabling higher loading of the slips 48 against the interior of the casing 18 without the risk of deformation or rupture of the casing 18. In the embodiment shown, the casing collar 120 is positioned about, and spaced from, the outer circumference of the envelope formed by the slips 48. In this position, the casing collar 120 extends along the outside of the casing 18 to an area that largely overlaps a contact area 122 of the slips 48 of the spear (not shown). The collar 120 includes a first end 124, a second end 126 that preferably extends to a position below the lowest terminus of the slips 48, a generally circumferential inner surface having threaded portion 128 adjacent the first end 124, and a recessed portion 138 adjacent the second end 126. Immediate to the second end 126 of the casing collar 120 is an inwardly projecting flange 134 having a seal 136 disposed therein. A fill aperture 130 and a vent aperture 132 located on opposed sides of the casing collar 120 provide communication with the recessed portion 138. The apertures 130, 132 may be plugged with plugs (not shown).

To use the casing collar 120, the casing collar 120 is first slipped over a length of casing 18 and a filler material is injected through the fill aperture 130 into the recess 138 that is bounded by the casing collar 120 and the casing 18 while the recess 138 is vented out the vent aperture 132. The filler material is a fast setting, low viscosity fluid such as an Alumilite urethane resin made by Alumilite Corp. in Kalamazoo, Mich. that sets up in three minutes after mixing, pours like water, and withstands drilling temperatures and pressures once cured. The filler material conforms to all casing abnormalities and transfers the load from the casing 18 to the collar 120 to increase the effective burst strength of the casing 18 when slips 48 are loaded against the inside of the casing 18. The recess 138 may be undercut as shown or may be tapered, grooved, knurled, etc. to aid in retaining the filler material. The filler material creates a continuous bearing surface between the outer diameter (OD) of the casing 18 and the collar 120 where there would otherwise be gaps caused by irregularities in the casing OD and circularity. Further, the filler material does not pose a disposal hazard and adds no components to the wellbore. The use of the collar 120 and filler material allows for greater loading of the slips 48 within the casing 18, such as where thousands of feet of casing are suspended by the slips 48, by substantially reducing the risk of rupture or plastic deformation of the casing 18. Thus, the collar 120 and filler material enables drilling deeper into the earth with casing 18.

As an alternative to the filler material, a mechanical wedge (not shown) may be positioned intermediate of the collar 120 and the casing 18. In another embodiment, a stabilizer (not shown) may be incorporated with the collar 120.

In another aspect, the present invention provides a method for drilling with casing comprising positioning a collar about an exterior of the casing, the collar having an inner circumferential recess formed therein; filling at least a portion of the recess with a filler material; clamping a top drive adapter to the inside of the casing opposite the recess of the collar; and rotating the top drive adapter and casing, thereby drilling with the casing.

In another aspect, the present invention provides a gripping apparatus of use in servicing a wellbore comprising a body having a contact surface for gripping a tubular; a first engagement member having a first height disposed on the contact surface; and a second engagement member having a second height disposed on the contact surface. In one embodiment, a change in load supported by the first engaging member causes the second engaging member to engage the tubular.

While the foregoing is directed to embodiments of the present invention, other and further embodiments of the invention may be devised without departing from the basic scope thereof, and the scope thereof is determined by the claims that follow.

We claim:

1. A method for suspending and turning a tubular using a top drive, comprising:
   - gripping an outside of the tubular with a second gripping member;
   - moving the second gripping member toward a first gripping member to couple the second gripping member to the first gripping member;
   - actuating the first gripping member to engage an inside of the tubular; and
   - rotating the tubular to make up a connection between the tubular and a tubular string.

2. The method of claim 1, wherein the tubular comprises casing.

3. The method of claim 1, further comprising providing a thrust force to the tubular string, the thrust force at least partially transferred to the tubular string through the first gripping member.

4. The method of claim 1, wherein torque is transferred to the tubular string through the second gripping member.

5. The method of claim 1, wherein torque is transferred to the tubular string through the first gripping member.

6. The method of claim 1, further comprising axially moving the second gripping member to compensate for motion of the casing caused by the make-up of the connection.

7. The method of claim 1, further comprising pivoting the second gripping member into alignment with the first gripping member.

8. The method of claim 1, further comprising coupling the second gripping member to the first gripping member such that torque is transferable therebetween.

9. The method of claim 1, wherein the second gripping member is coupled to a swivel.

10. The method of claim 1, wherein the second gripping member comprises an elevator.

11. The method of claim 1, wherein the second gripping member grips and rotates the tubular.

12. The method of claim 1, wherein the second gripping member rotates and supports a weight of the tubular.

13. A system for suspending and turning a tubular string, comprising:

a top drive;

an internal gripping member driven by the top drive, the internal gripping member comprising a body, one or more slips, and an actuator for engaging the one or more slips with an interior surface of the tubular string; and an external gripping member capable of engaging an outside portion of the tubular string, wherein the external gripping member is selectively movable to couple and decouple from the internal gripping member.

14. The system of claim 13, wherein the one or more slips include a plurality of wickers extending therefrom, the wickers having variable heights.

15. The system of claim 13, further comprising a collar disposed about an exterior of the tubular string and a conforming element disposed between the collar and the exterior of the tubular string.

16. The system of claim 13, wherein one or more bails is connected by a swivel to the top drive.

17. The system of claim 16, further comprising a lifting device that raises and lowers the external gripping member along the one or more bails.

18. The system of claim 16, wherein at least a portion of the external gripping member freely rotates with the tubular string.

19. The system of claim 13, wherein the external gripping member has a mating end, and the internal gripping member has a corresponding mating end that engages with the mating end of the external gripping member to transmit rotational forces therebetween.

20. The system of claim 13, wherein the actuator comprises a biasing member that urges the one or more slips a distance in one direction and a swivel mechanism that selectively controls the length of the distance.

21. The system of claim 13, wherein the actuator comprises a spindle drive.

22. The system of claim 13, wherein the external gripping member for engaging the tubular is hydraulically actuated.

23. The system of claim 13, wherein the external gripping member is coupled to a swivel.

24. A method for suspending and turning a tubular, comprising:

gripping an outside of the tubular with a gripping member;

positioning the tubular in alignment with a top drive after gripping the tubular;

moving the gripping member toward a torque housing to couple the torque housing to the gripping member; and rotating the tubular to make up a connection between the tubular and a tubular string.

25. The method of claim 24, wherein the torque housing further comprises a second gripping member.

26. The method of claim 25, further comprising actuating the second gripping member to engage the inside of the tubular.

27. The method of claim 24, wherein gripping the tubular comprises supporting a weight of the tubular.

28. The method of claim 24, wherein coupling the torque housing to the gripping member comprises connecting the torque housing to the gripping member.

29. The method of claim 28, further comprising transferring torque through a connection connecting the torque housing to the gripping member.

30. The method of claim 29, wherein the connection allows the gripping member to move axially relative to the torque housing.

31. The method of claim 24, wherein the torque housing is rotatably coupled to the top drive.

32. The method of claim 24, wherein rotating the tubular comprises rotating the tubular using the torque housing, wherein the top drive is used to rotate the torque housing.

33. The method of claim 24, further comprising positioning the gripping member below the top drive to enable coupling of the torque housing and the gripping member.

34. The method of claim 24, wherein positioning the tubular comprising pivoting the tubular relative to the gripping member to align the tubular with the top drive.

35. The method of claim 24, wherein positioning the tubular comprises pivoting the gripping member relative to the top drive to align the tubular with the top drive.

36. The method of claim 24, wherein the torque housing is disposed above the gripping member.

37. The method of claim 24, wherein the top drive is disposed above the torque housing for rotating the tubular.

* * * * *

UNITED STATES PATENT AND TRADEMARK OFFICE

CERTIFICATE OF CORRECTION

PATENT NO. : 7,513,300 B2
APPLICATION NO. : 11/688619
DATED : April 7, 2009
INVENTOR(S) : Pietras et al.

It is certified that error appears in the above-identified patent and that said Letters Patent is hereby corrected as shown below:

Column 12, Claim 6, Line 55, please delete "1" and insert --2-- therefor.

Signed and Sealed this

Thirtieth Day of March, 2010

David J. Kappos

David J. Kappos
*Director of the United States Patent and Trademark Office*